US006520781B2

(12) United States Patent
Koide et al.

(10) Patent No.: US 6,520,781 B2
(45) Date of Patent: Feb. 18, 2003

(54) CONNECTOR AND METHOD FOR MOUNTING A CONNECTOR

(75) Inventors: Takashi Koide, Yokkaichi (JP); Masahiko Aoyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/026,024

(22) Filed: Dec. 21, 2001

(65) Prior Publication Data

US 2002/0098737 A1 Jul. 25, 2002

(30) Foreign Application Priority Data

Dec. 22, 2000 (JP) ..... 2000-391306

(51) Int. Cl.[7] ..... H01R 4/66
(52) U.S. Cl. ..... 439/97
(58) Field of Search ..... 439/63, 98, 97, 439/95

(56) References Cited

U.S. PATENT DOCUMENTS 4,591,216 A * 5/1986 McClune ..... 439/97
5,304,067 A * 4/1994 Inaba et al. ..... 439/97
5,691,506 A * 11/1997 Miyazaki et al. ..... 439/98
6,042,396 A * 3/2000 Endo et al. ..... 439/98

FOREIGN PATENT DOCUMENTS

JP 8-96895 4/1996

* cited by examiner

*Primary Examiner*—Gary Paumen
(74) *Attorney, Agent, or Firm*—Anthony J. Casella; Gerald E. Hespos

(57) ABSTRACT

A connector having an improved force for locking a shielding terminal. The connector (10) has a housing (20) and a ground terminal (50) is mounted into a shielded casing (C) after a shielding terminal (15) is partly locked in a cavity (21) of the housing (20) is partly locked by a locking portion (25) and then fully locked by touching pieces (59) of the ground terminal (50). The connector (10) can doubly lock the shielding terminal (15). Hence, the locking force for locking the shielding terminal (15) can be improved.

10 Claims, 15 Drawing Sheets

CONNECTOR AND METHOD FOR MOUNTING A CONNECTOR

BACKGROUND OF THE INVENTION

1. Field of the Invention

The invention relates to a connector with a shielding terminal and to a method for mounting such a connector.

2. Description of the Related Art

A connector with a shielding terminal is disclosed in Japanese Unexamined Patent Publication No. 8-96895. This connector is configured for mounting to an electrically conductive panel. The connector includes a housing and the shielding terminal can be accommodated in the housing. The housing is formed with a lock that engages the shielding terminal to lock the properly inserted shielding terminal in the housing. A ground terminal is assembled in the housing and shorts the shielding terminal to the conductive panel.

A conventional unshielded connector also has a housing formed with a lock to hold the unshielded terminal in the housing. However, the unshielded connector further has a retainer to lock the unshielded terminal redundantly.

It is not easy to apply the retainer of a conventional unshielded connector to a connector with shielding terminal. More particularly, the ground terminal is arranged around the shielding terminal and interferes with the retainer. As a result, only the locking portion in the conventional shielded connector locks the shielding terminal, and the locking force is not as great as the conventional unshielded connector with a retainer.

In view of the above, an object of the present invention is to provide a connector and a connector mounting method allowing for an improved locking force for a shielding terminal.

SUMMARY OF THE INVENTION

The invention is directed to a connector with a shielding terminal. The connector comprises a housing for accommodating and partly locking a shielding terminal. The shielding terminal comprises and inner terminal and a shielding shell that surrounds the inner terminal. A ground terminal is mountable on the housing to short the shielding shell to a fixed article. The ground terminal also is configured to fully lock the shielding terminal in the housing. Thus, the ground terminal provides a higher locking force of the shielding terminal in the housing.

The ground terminal preferably is mounted in a direction that intersects an insertion direction of the shielding terminal into the housing. Thus, the ground terminal prevents movement of the shielding terminal in a withdrawal direction from the housing. Additionally, a force acting in the withdrawal direction of the shielding terminal is not likely to detach the ground terminal from the housing because this force acts in a direction intersecting the mounting direction of the ground terminal. As a result, the ground terminal can be held firmly to lock the shielding terminal, and the locking force of the connector for locking the shielding terminal can be improved.

The ground terminal is mounted on the housing for movement between a partial locking position where insertion and withdrawal of the shielding terminal is permitted and a full locking position where the ground terminal fully locks the shielding terminal. Thus, the shielding terminal can be inserted after the housing and the ground terminal are assembled. The connector achieves efficiencies because the housing and the ground terminal can be handled as one part during transportation to the site where the shielding terminal is mounted and during mounting of the shielding terminal into the housing.

Both the housing and the ground terminal are formed with mount holes through which a mounting member is inserted to fix the shielding terminal to the fixed article. The mount holes of the housing and the ground terminal preferably are not aligned when the ground terminal is at the partial locking position, but are aligned when the ground terminal is at the full locking position.

The mount holes are not aligned and the connector cannot be mounted on the fixed article if the ground terminal is at the partial locking position. This prevents an operator from forgetting to push the ground terminal to the full locking position.

The ground terminal comprises a contact piece that can be brought into contact with the shielding shell when the ground terminal is at the full locking position. However, the contact piece does not contact the shielding shell when the ground terminal is at the partial locking position. As a result, the shielding terminal and the contact piece do not interfere with each other when the shielding terminal is mounted into the housing, and insertion resistance of the shielding terminal can be reduced.

The housing may comprise a detecting portion, and a portion of the ground terminal can be disposed in the detecting portion when the ground terminal is in the partial locking position. The presence of the ground terminal in the detecting portion of the housing can be detected to check the position of the ground terminal. More particularly, a leading end of the contact piece may be exposed at a position detectable from outside when the ground terminal is at the partial locking position. Thus, the proper position of the ground terminal can be detected by projecting a light for photoelectric detection to the leading end portion of the contact piece.

The invention also is directed to a method for mounting a connector for fixing a shielding terminal to an electrically conductive fixed article. The method comprises inserting the shielding terminal in a housing, and mounting a ground terminal on the housing to electrically short a shielding shell of the shielding terminal and the fixed article, and thereby locking the shielding terminal in the housing by means of the ground terminal.

The shielding terminal is partly locked in the housing by a partial locking means during the shielding terminal inserting step and fully locked in the housing by the ground terminal in the ground terminal mounting step.

The ground terminal preferably is moved in the ground terminal mounting step in a direction that intersects an insertion direction of the shielding terminal into the housing in the shielding terminal inserting step.

The ground terminal may be moved between a partial locking position where insertion and withdrawal of the shielding terminal are permitted and a full locking position where the ground terminal fully locks the shielding terminal.

The method may further comprise a step of detecting whether the ground terminal is in the partial locking position by verifying whether a portion of the ground terminal is in a detecting portion of the housing.

These and other objects, features and advantages of the invention will become more apparent upon reading of the following detailed description of preferred embodiments and accompanying drawings. It should be understood that even though embodiments are described separately, single features thereof may be combined to additional embodiments.

Hereinafter, one preferred embodiment of the present invention is described with reference to FIGS. 1 to 16.

DETAILED DESCRIPTION OF THE PREFERRED EMBODIMENTS

Figure 1:
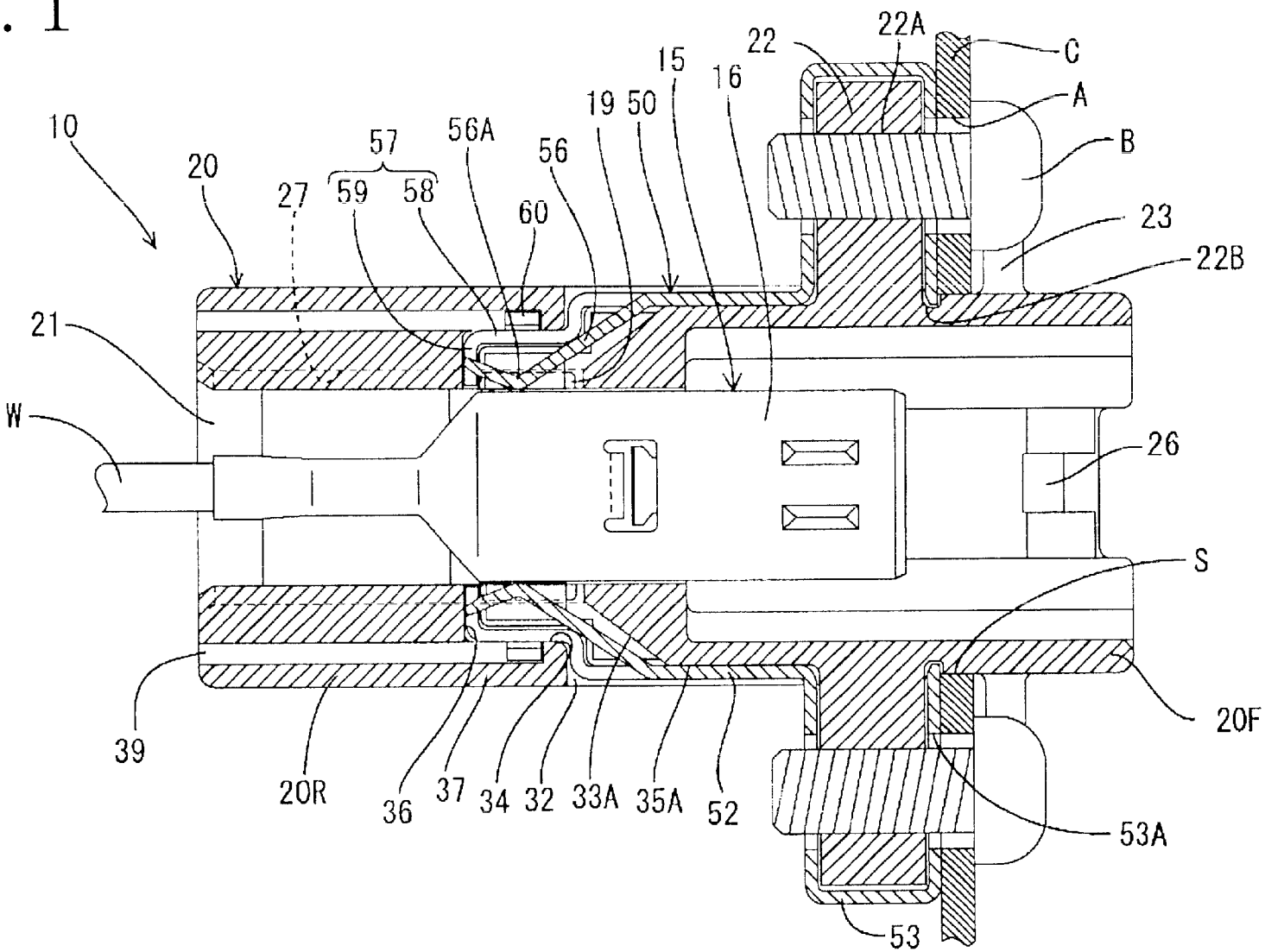
FIG. 1 is a section of a connector according to the invention.
Figure 2:
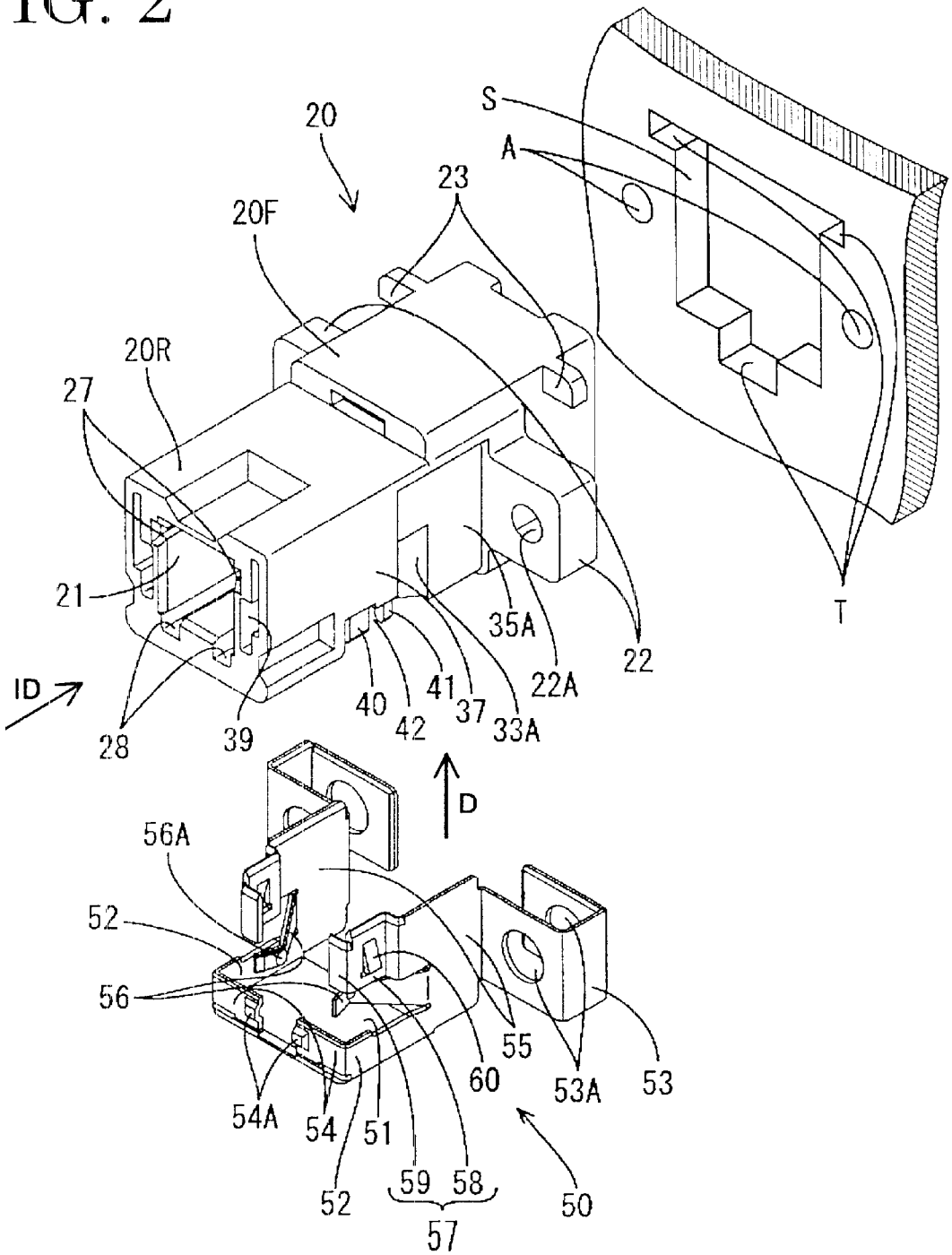
FIG. 2 is an exploded perspective view of the connector.

A connector in accordance with the invention is identified by the numeral 10, as shown in FIG. 1. The connector 10 is assembled to a substantially box-shaped shielded casing C that is formed from an electrically conductive plate material. The casing C has a mounting surface formed with an opening S through which the connector 10 is insertable. Mount holes A extend through the mounting surface for fixing the connector 10, as shown in FIGS. 1 and 2. Escape portions T bulge out at opposite lateral edges and at the bottom edge of the opening S.

Figure 9:
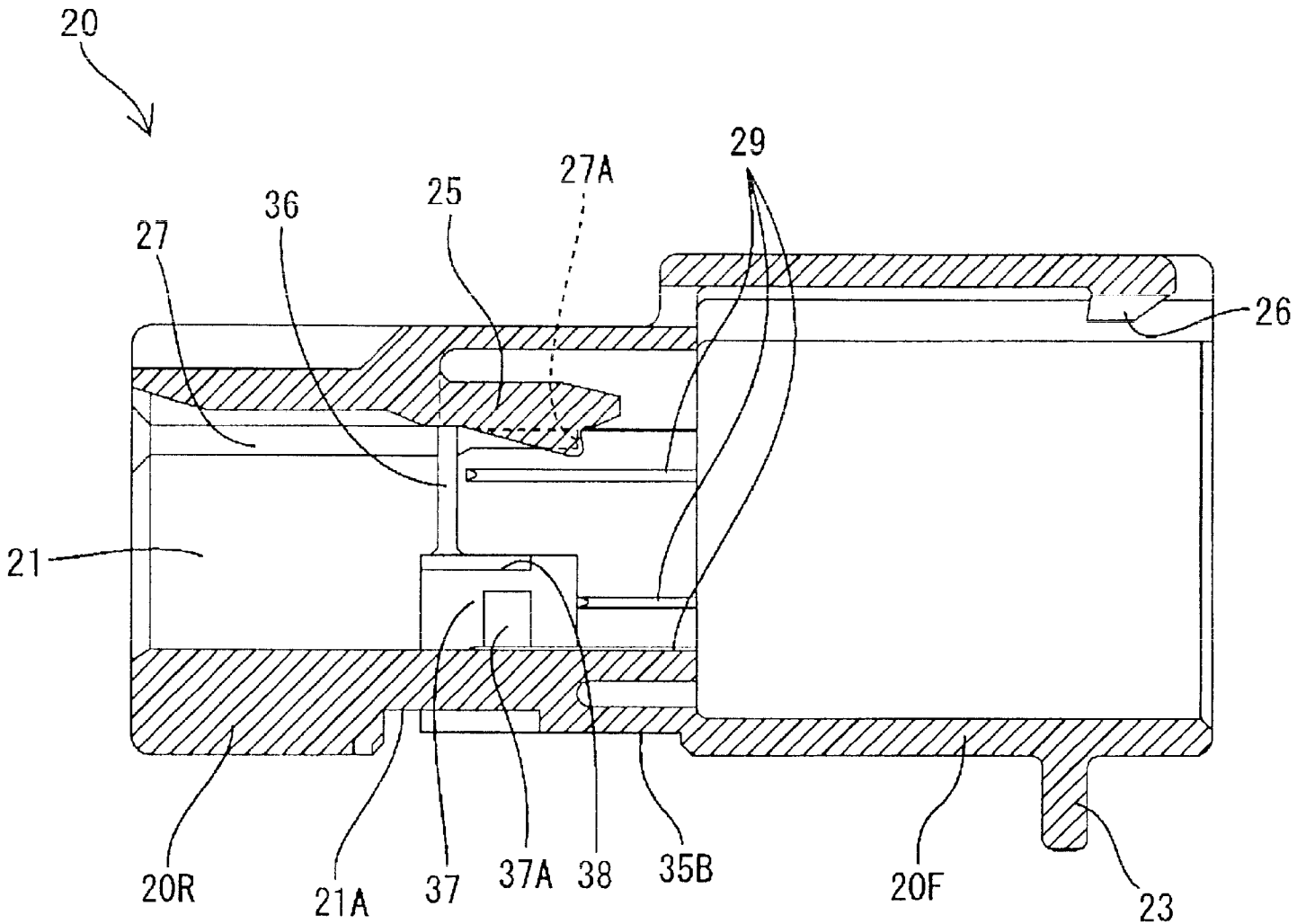
FIG. 9 is a side view in section of the housing.
Figure 10:
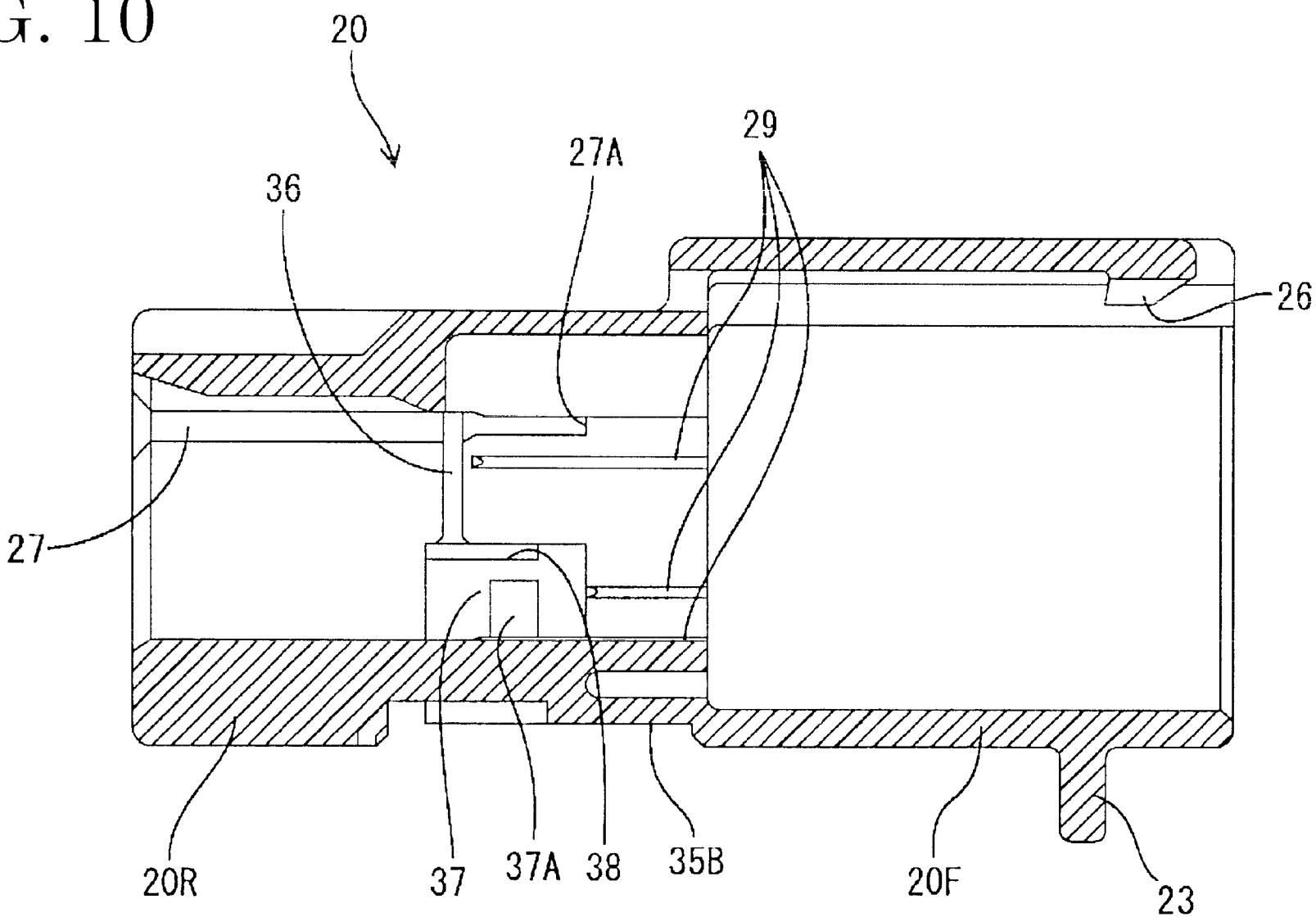
FIG. 10 is a side view in section of the housing at an other position.
Figure 11:
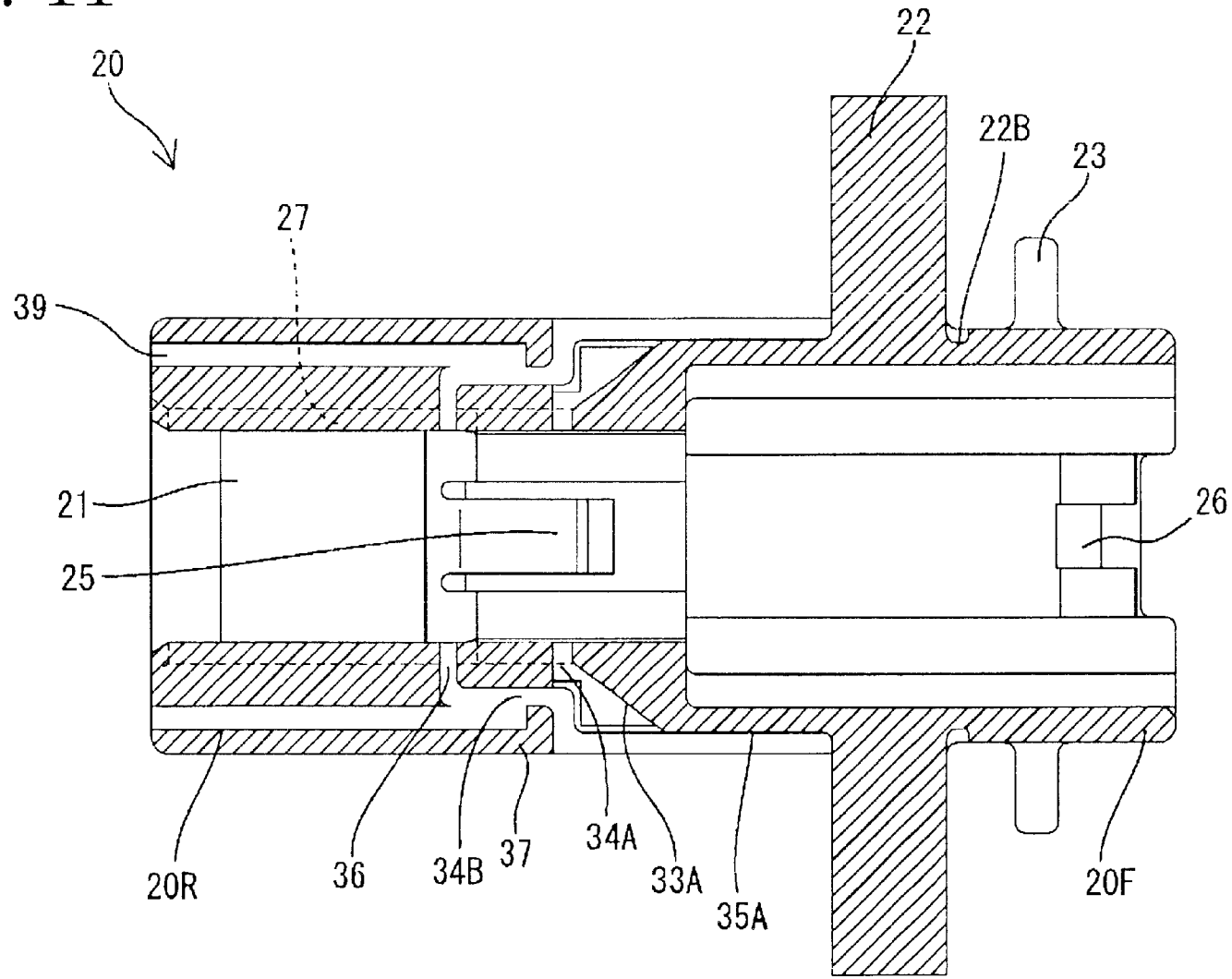
FIG. 11 is a plan view in section of the housing.

The connector 10 has a housing 20 formed integrally or unitarily of a synthetic resin. A substantially rectangular tubular receptacle 20F opens forward or toward a mating connector (not shown) at a front part of the housing 20, as shown in FIGS. 1 and 9. Bulging portions 23 bulge out from each of the left and right side surfaces of the receptacle 20F and from a central position on the bottom wall near the opening edge. The receptacle 20F of the housing 20 is at least partly insertable into the opening S of the shielded casing C by aligning the bulging portions 23 with the corresponding escape portions T.

The receptacle 20F is formed to mate with an unillustrated mating connector, and a housing lock 26 is formed on the ceiling of the receptacle 20F for locked engagement with the mating connector. Fixing pieces 22 bulge out from the left and right side walls of the receptacle 20F at positions displaced from the corresponding bulging portions 23 by a distance that is slightly longer than the thickness of the shielded casing C. The fixing pieces 22 are formed with fixing holes 22A that align with the mount holes A of the shielded casing C when the receptacle 20F is inserted into the opening S and moved down. Insertion grooves 22B are formed in the outer surface of the receptacle 20F forward of and substantially adjacent the fixing pieces 22.

A terminal holding portion 20R is provided in the housing 20 rearward of and substantially continuously with the receptacle 20F. The terminal holding portion 20R is formed with a cavity 21 of substantially rectangular cross section that penetrates the terminal holding portion 20R in forward and backward directions. The shielding terminal 15 is inserted into the rear of the cavity 21 in an insertion direction ID, as shown in FIG. 2. A lock 25 is cantilevered from the ceiling of the cavity 21 and is elastically or resiliently deformable toward and away from the cavity 21 to partly lock the shielding terminal 15.

The shielding terminal 15 is connected with the leading end of a shielded wire or cable W. The shielded wire W has a core in the center, an insulating layer around the core, a shield layer around the insulation layer, and a sheath as an outermost layer. The shielding terminal 15 is comprised of a shielding shell 16, an inner terminal 17 connected with the core and disposed within the shielding shell 16 and a dielectric element 18 between the shielding shell 16 and the inner terminal 17.

Figure 3:
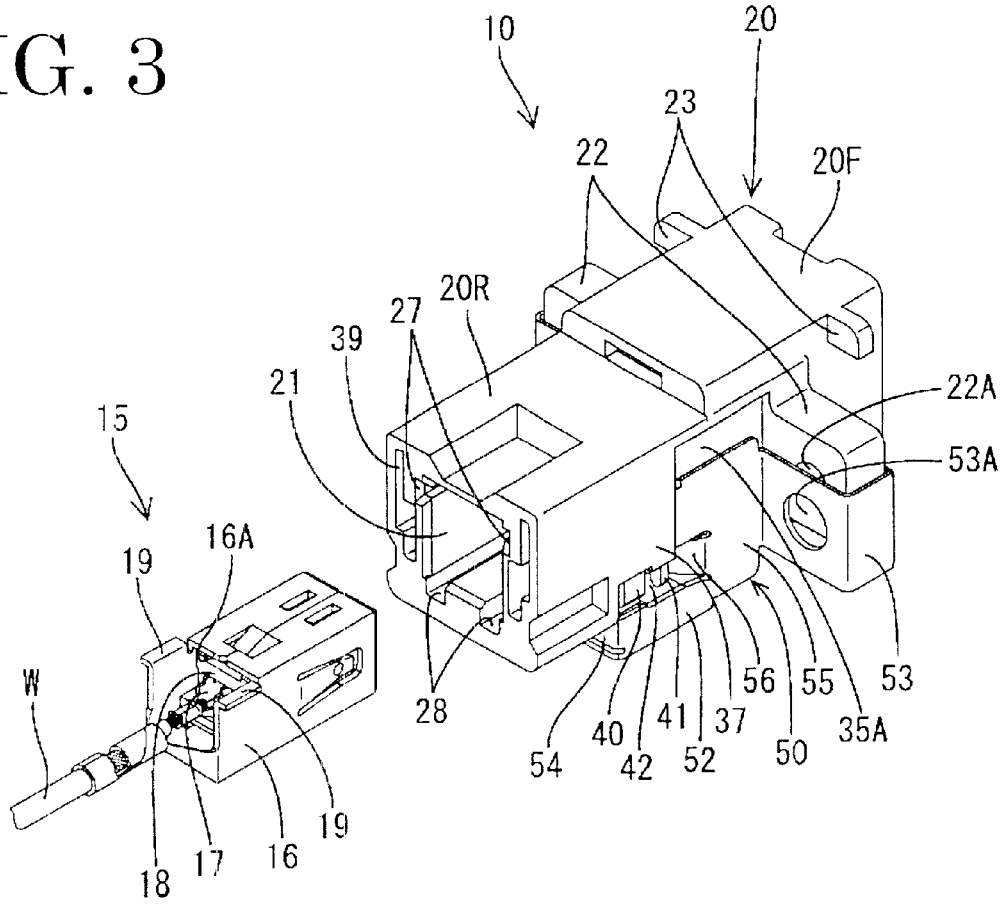
FIG. 3 is a perspective view of the connector with a ground terminal mounted at a partial locking position.

A rear portion of the ceiling wall of the shielding shell 16 is open, as shown in FIG. 3, and the front of the open portion defines a locking edge 16A that engages the lock 25. Opposite sides of the open portion are bent outwardly to form a pair of stabilizers 19.

Figure 6:
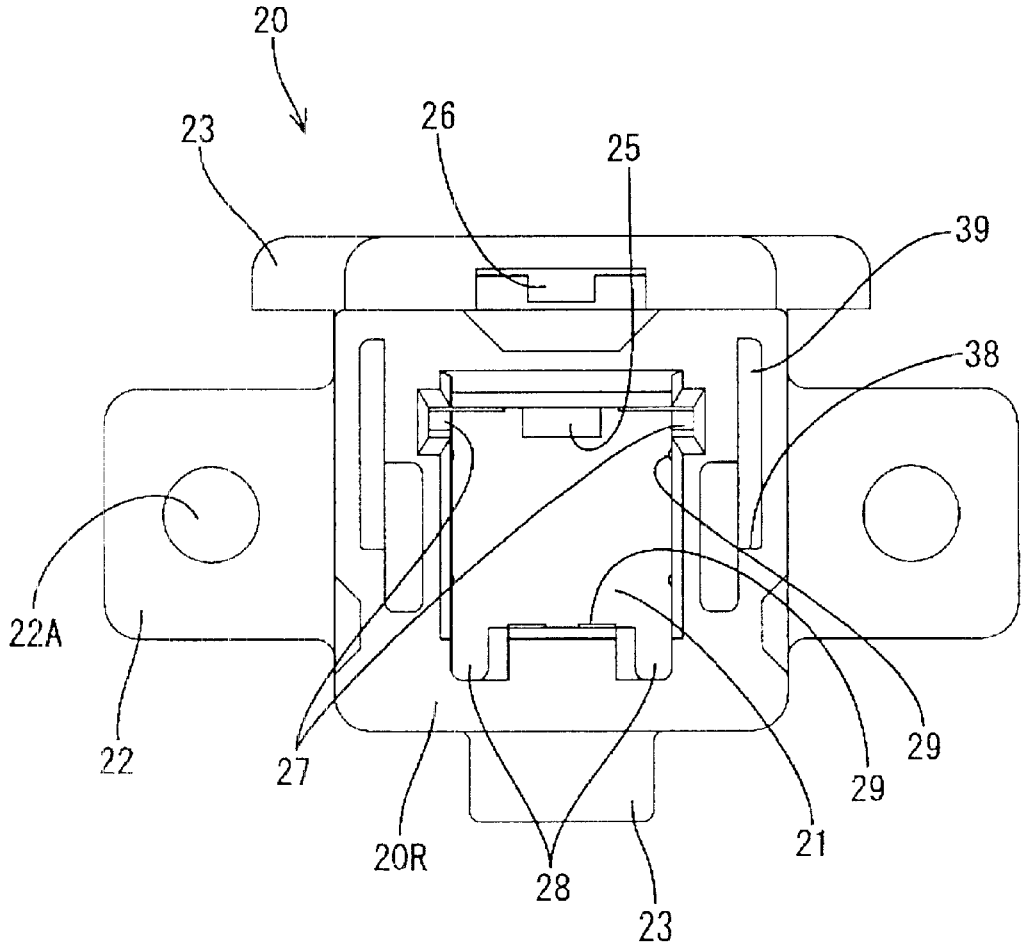
FIG. 6 is a rear view of a housing.

Guide grooves 27 are formed in the cavity 21, as shown in FIGS. 6 and 9, to receive the stabilizers 19 for guiding the shielding terminal 15 into the cavity 21. The guide grooves 27 extend longitudinally from the rear end of the cavity 21 to a position substantially aligned with the portion of the lock 25 that engages the shielding terminal 15. Rear ends of the guide grooves 27 define closed contact portions 27A that contact the stabilizers 19. The guide grooves 27 are narrower at the back than at the entrance. Thus, the shielding terminal 15 can be inserted with a small force because the stabilizers 19 can pass the wide portions of guide grooves 27 at an initial stage of insertion of the shielding terminal 15. The shielding terminal 15 can be held without shaking in the narrower portion of the guide grooves 27 at a final stage of insertion.

Detection grooves 28 are formed at opposite widthwise ends of the bottom surface of the cavity 21 over the entire length. The detection grooves 28 are used to detect whether leading end portions of contact pieces 56 of the ground terminal 50 are located in the detection grooves 28 preferably by passing laser beams along the detection grooves 28 when the ground terminal 50 is at the first or partial locking position in the housing 20.

Figure 5:
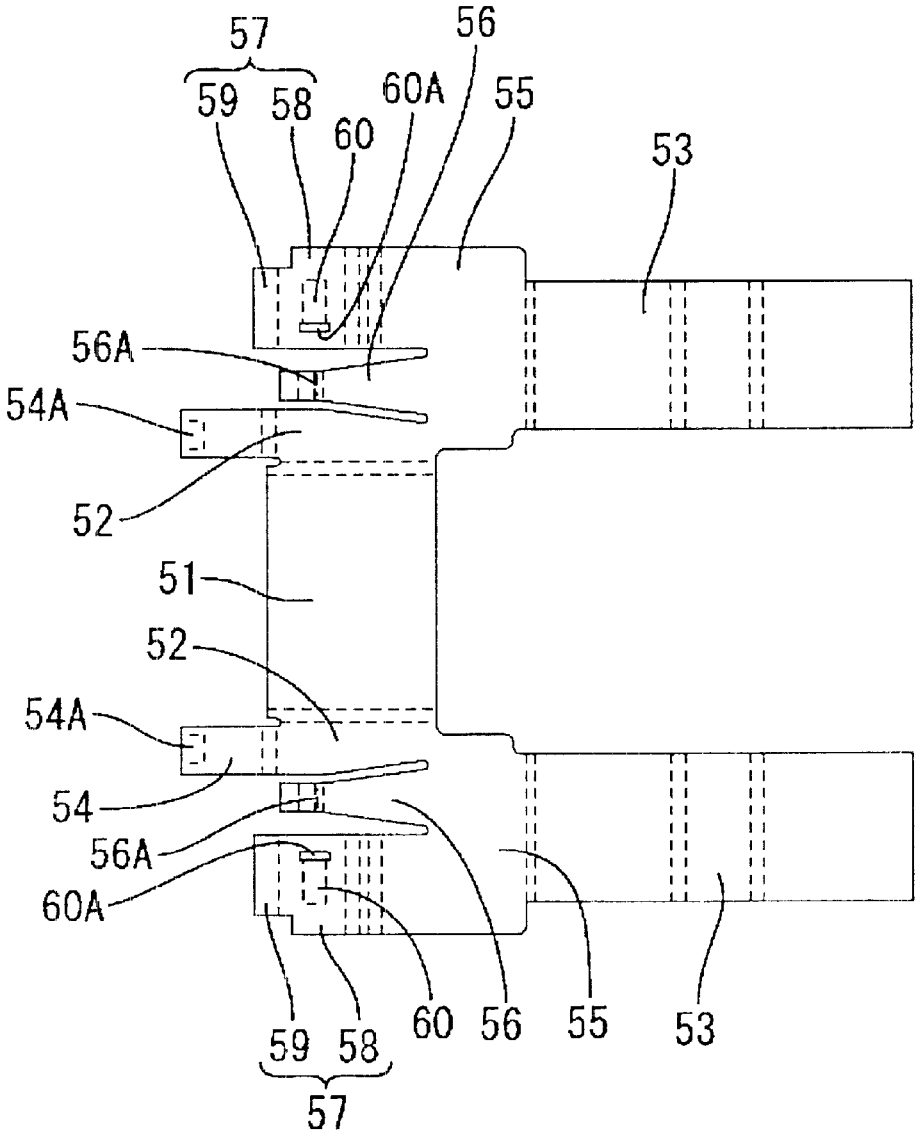
FIG. 5 is a development of the ground terminal.
Figure 14:
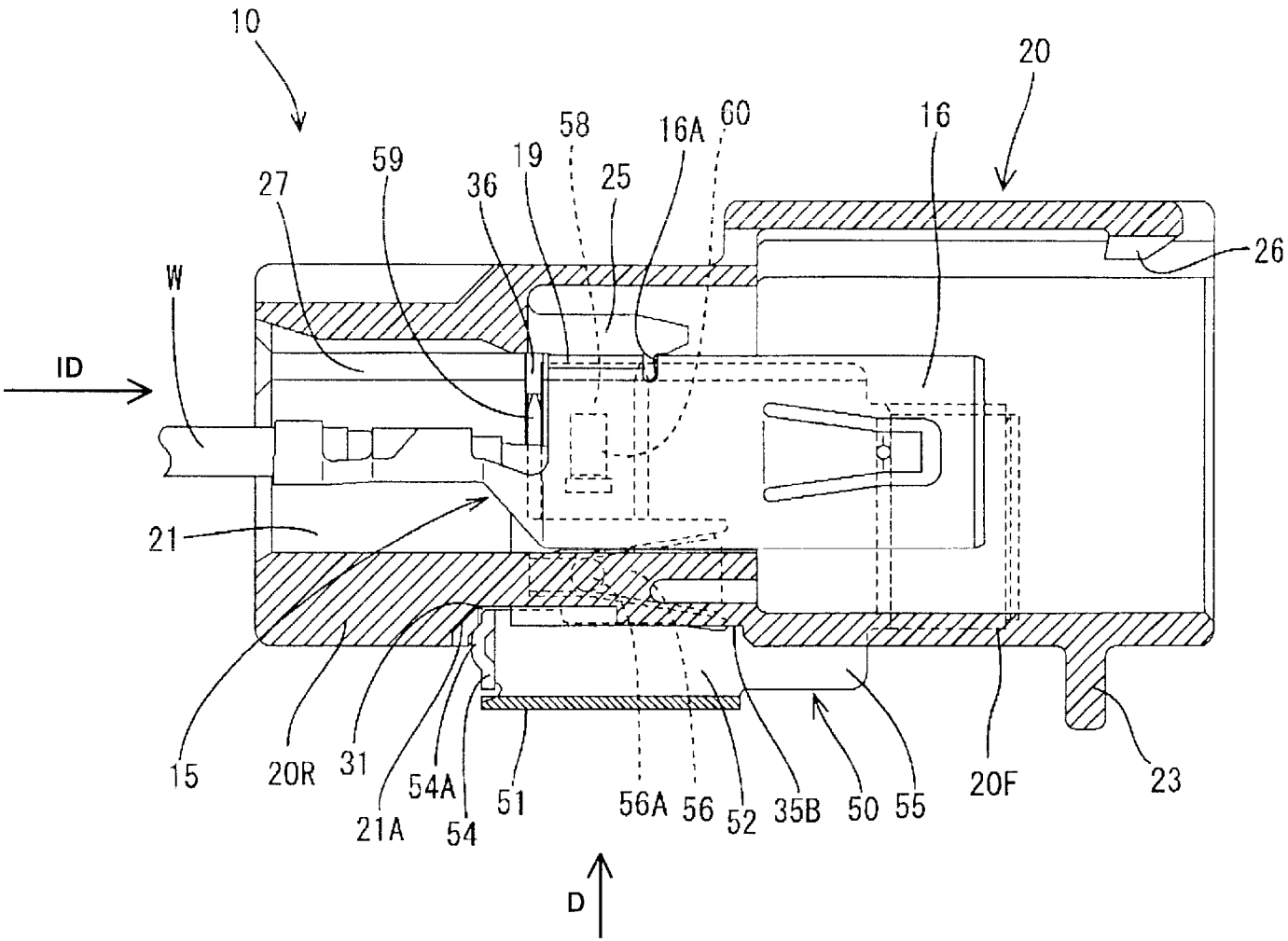
FIG. 14 is a side view in section of the connector when a shielding terminal is inserted with the ground terminal mounted at the partial locking position.

The connector 10 further includes a ground terminal 50, as shown in FIG. 2. The ground terminal 50 is formed by stamping, bending, folding and/or embossing an electrically conductive plate, as shown in FIG. 5, to define a bottom wall 51 and two opposed lateral walls 52 that project from the bottom wall 51. The lateral walls 52 have their rear ends bent inward along the rear end of the bottom wall 51 to form elastically or resiliently deformable full locking pieces 54. Substantially opposed full locking projections 54A project at ends of the full locking pieces 54. The two full locking projections 54A function to hold the ground terminal 50 at a partial locking position, as shown in FIG. 14 and as described further below. The full locking projections 54A also can enter and engage in the detection grooves 28 of the housing 20 when the ground terminal 50 is at a full locking position shown in FIG. 15.

Figure 4:
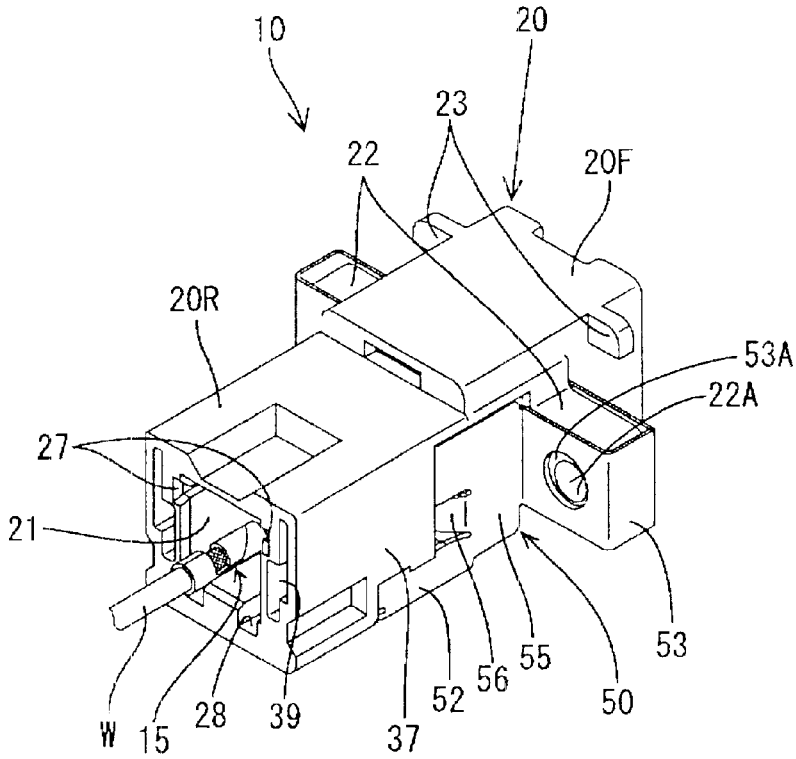
FIG. 4 is a perspective view of the connector with the ground terminal mounted at a full locking position.

Two opposed standing walls 55 are formed at ends of the lateral walls 52 opposite the full locking pieces 54, and one surrounding piece 53 bulges out from each standing wall 55, as shown in FIG. 2. The surrounding pieces 53 define an inwardly open a U-shape, and can align and engage with the fixing pieces 22. A through hole 53A is formed in each surrounding piece 53 and aligns with the corresponding fixing hole 22A when the surrounding pieces 53 are engaged properly with the fixing pieces 22, as shown in FIG. 4.

Elastically or resiliently deformable contact pieces 56 are cantilevered at an intermediate height of each standing wall 55 and can be biased against a side surface of the shielding shell 16 of the shielding terminal 15 in the cavity 21, as shown FIG. 1. The contact pieces 56 extend inwardly or toward the cavity 21 so that the spacing between the contact pieces 56 gradually decreases. Additionally, each contact piece 56 gradually narrows from its base end toward its leading end. The leading ends of the contact pieces 56 are bent out to form substantially V-shaped contact leading ends 56A for contact with the shielding terminal 15, as shown in FIGS. 1 and 2.

An engaging piece 57 projects from of each standing wall 55 on a side of the respective contact piece 56 opposite from the lateral end 52, as shown in FIG. 2. The engaging pieces 57 extend inwardly in steps and opposing pieces 58 are formed at positions one step in from the respective standing walls 55. A locking claw 60 is formed substantially in the middle of each opposing piece 58 by making a cut and bending a cut portion outwardly. The locking claws 60 engage the housing 20 to hold the entire ground terminal 50 at its partial locking position. The locking claws 60 of this embodiment are formed by punching oblong holes 60A in the opposing pieces 58 beforehand (see FIG. 5) so that the bottom ends of the locking claws 60 are straight.

Resiliently deformable touching pieces 59 are formed by bending the leading ends of the opposing pieces 58 inwardly to be at substantially right angles. The upper ends of the touching pieces 59 are cut off so that the touching pieces 59 are narrower than the opposing pieces 58.

Figure 7:
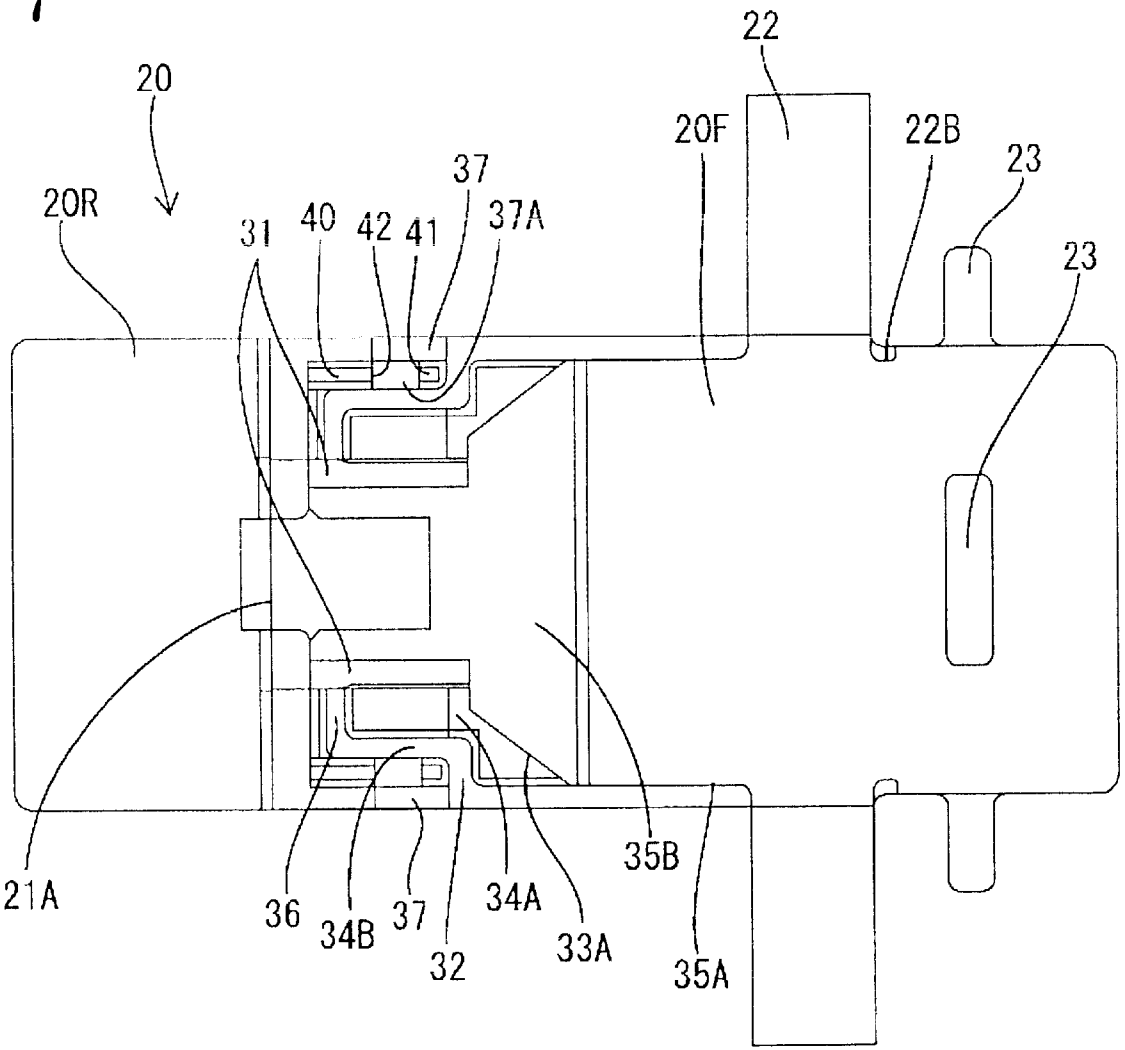
FIG. 7 is a bottom view of the housing.
Figure 8:
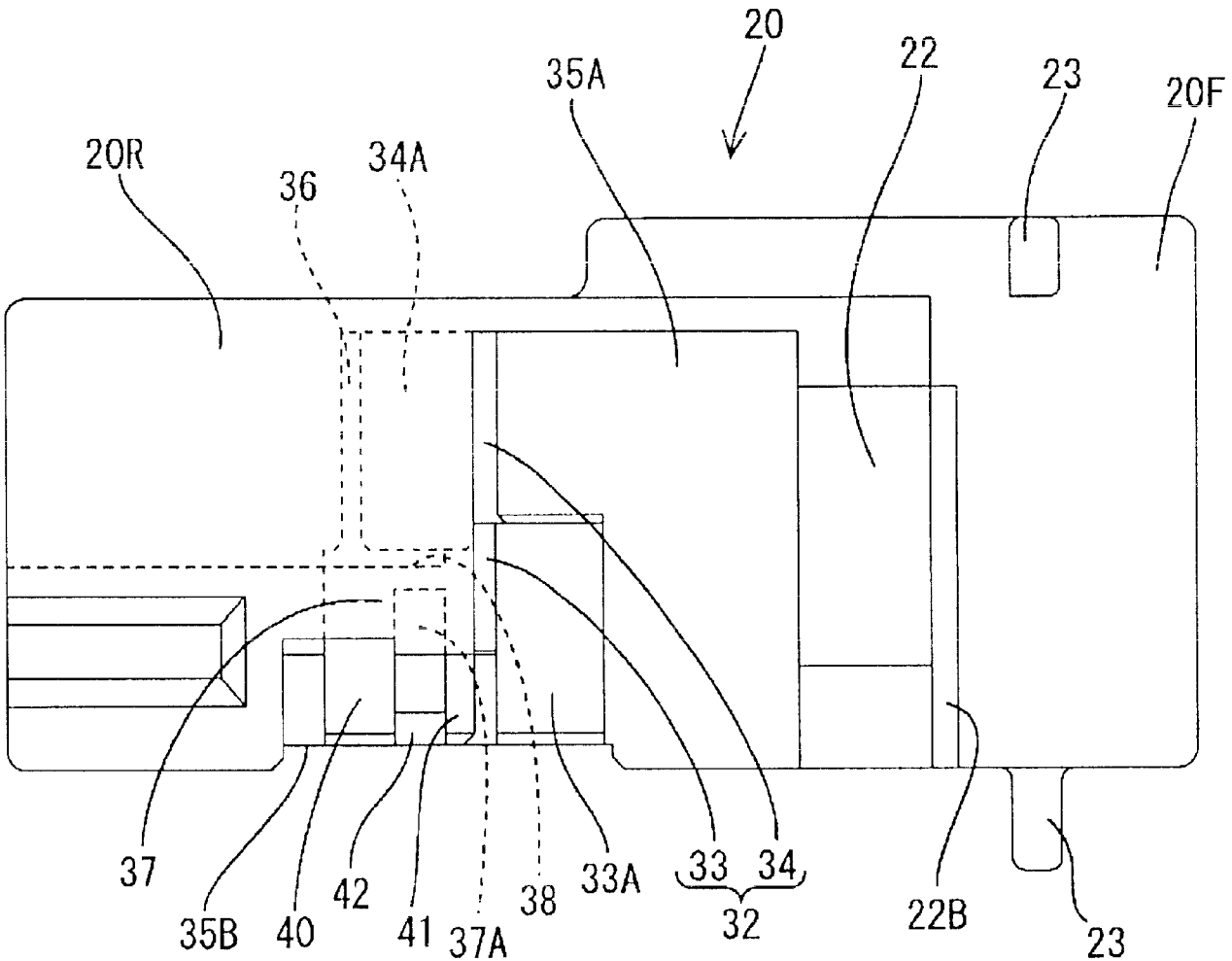
FIG. 8 is a side view of the housing.

The ground terminal 50 is mounted into the housing 20 in the direction D. As shown in FIG. 7, the mount holes 31 used to mount the ground terminal 50 are formed at the left and right sides of the bottom surface of the terminal holding portion 20R of the housing 20 and communicate with the cavity 21. Substantially vertically extending insertion slots 32 are formed in the lateral walls of the terminal holding portion 20R and extend continuously with the mount holes 31. The insertion slots 32 enable the ground terminal 50 avoid interference with the terminal holding portion 20R when the ground terminal 50 is mounted in the mount holes 31. The bottom surface and the side surfaces of the terminal holding portion 20R are recessed adjacent the mount holes 31 and the insertion slits 32 to form lateral steps 35A and a bottom step 35B. The steps 35A and 35B are recessed to a depth substantially equal to the thickness of the metallic plate of the ground terminal 50. Thus the surrounding surfaces and the outer surfaces of the ground terminal 50 are substantially flush with each other when the ground terminal 50 is mounted.

Lower halves 33 of the insertion slits 32 in the lateral stepped portions 35A guide the contact pieces 56 of the ground terminal 50 into the cavity 21. Surfaces of the lower halves 33 adjacent the slits 32 are formed into slanted surfaces 33A that slope down toward the slits 32 at an angle to conform substantially to the inclination of the contact pieces 56. As shown in FIG. 7, a hook-shaped extending wall 34A is formed at one opening edge of an upper half 34 of each slit 32. The hook-shaped extending wall 34A extends substantially parallel with a corresponding side wall 37 of the terminal holding portion 20R and is substantially at the same depth position as the rear edge of the slanted surface 33A. Thus, stepped grooves 34B are formed between the side walls 37 of the terminal holding portion 20R and the cavity 21 and conform with the shape of the engaging pieces 57 of the ground terminal 50. Rear ends of the stepped grooves 34B define hooking portions 36 that accommodate the touching pieces 59. Further, as shown in FIG. 9, the hooking portions 36 of the stepped grooves 34B communicate with the guide grooves 27 for the stabilizers 19 substantially at right angles.

Receiving pieces 40 are formed at the side walls 37 of the terminal holding portion 20R where the opening edges of the mount holes 31 are located. The receiving pieces 40 are held closely in contact with the inner surfaces of the lateral ends 52 and the full locking pieces 54 of the ground terminal 50. The outer surfaces of the receiving pieces 40 are retracted inwardly from the surrounding surfaces substantially by the thickness of the ground terminal 50. Suspended pieces 41 are formed before and substantially parallel to the receiving pieces 40. Clearances 42 are defined between the suspended pieces 41 and the receiving pieces 40 to avoid interference with the locking claws 60 formed on the opposing pieces 58 when the ground terminal 50 is mounted into the housing 20.

Figure 12:
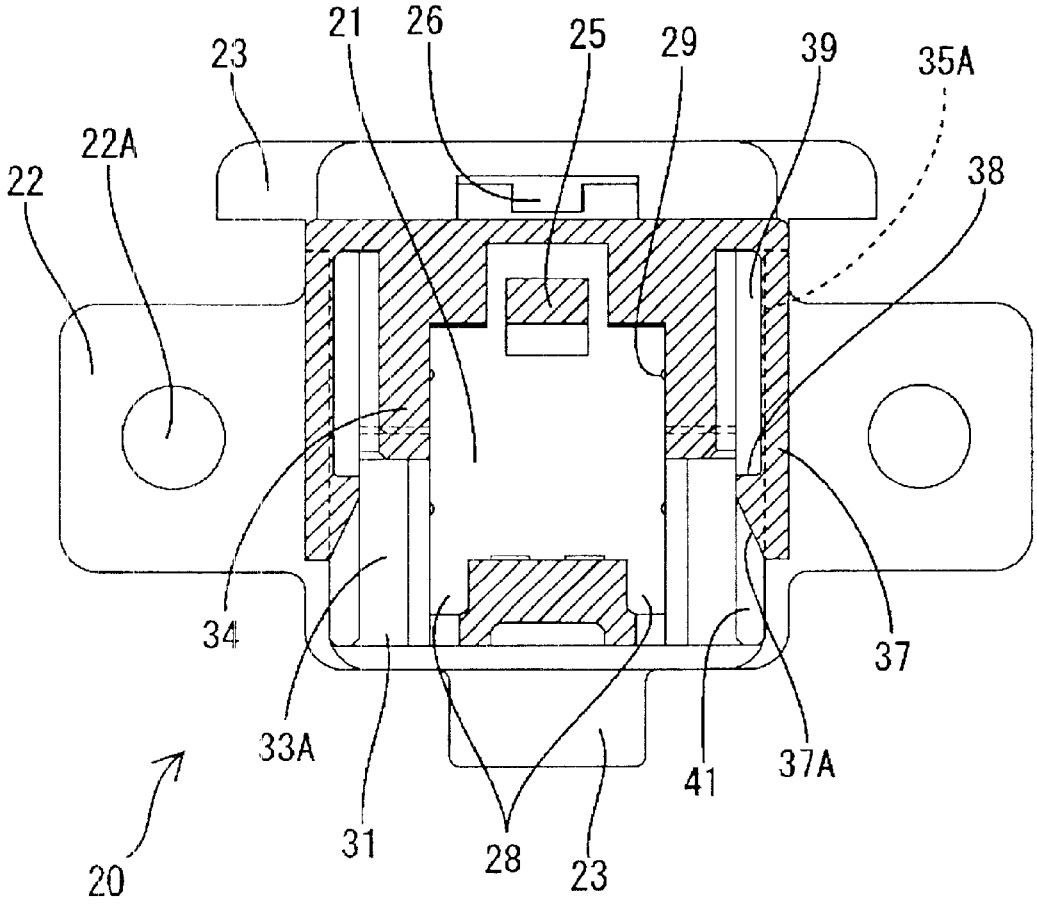
FIG. 12 is a section of the housing.

Upper inner ends of the side walls 37 of the terminal holding portion 20R are formed with slanted surfaces 37A that are continuous with the upper parts of the clearances 42 and stepped surfaces 38 are formed continuously with the slanted surfaces 37A, as shown in FIG. 12. Accordingly, the locking claws 60 deform along the slanted surfaces 37A during mounting of the ground terminal 50 and are restored resiliently to engage the stepped surfaces 38. In this way, the ground terminal 50 is held at its partial locking position. It should be noted that the stepped surfaces 38 are formed using mold removing holes 39 formed in the rear end surface of the terminal holding portion 20R.

The surrounding pieces 53 of the ground terminal 50 are aligned with the fixing pieces 22 of the housing 20 and the leading ends of the surrounding pieces 53 are inserted into the insertion grooves 22B to assemble the connector 10. Simultaneously, the engaging pieces 57 are aligned with the insertion slits 32 and the ground terminal 50 is pushed in the direction D toward the housing 20. At this time, the locking claws 60 of the engaging pieces 57 pass through the clearances 42 between the suspended pieces 41 and the receiving pieces 40 and resiliently deform along the slanted surfaces 37A inside the housing 20. Further pushing of the ground terminal 50 causes the contact pieces 56 to enter inside the receiving pieces 40 and the suspended pieces 41. The locking claws 60 are restored resiliently after passing the slanted surfaces 37A and engage the stepped surfaces 38 (see FIG. 13). The full locking projections 54A of the ground terminal 50 engage the edges of the mount holes 31 of the housing 20 (see FIG. 14) at this time. Thus, the ground terminal 50 cannot be pushed any further and is held at the partial locking position where it is prevented from disengagement from the housing 20.

Figure 13:
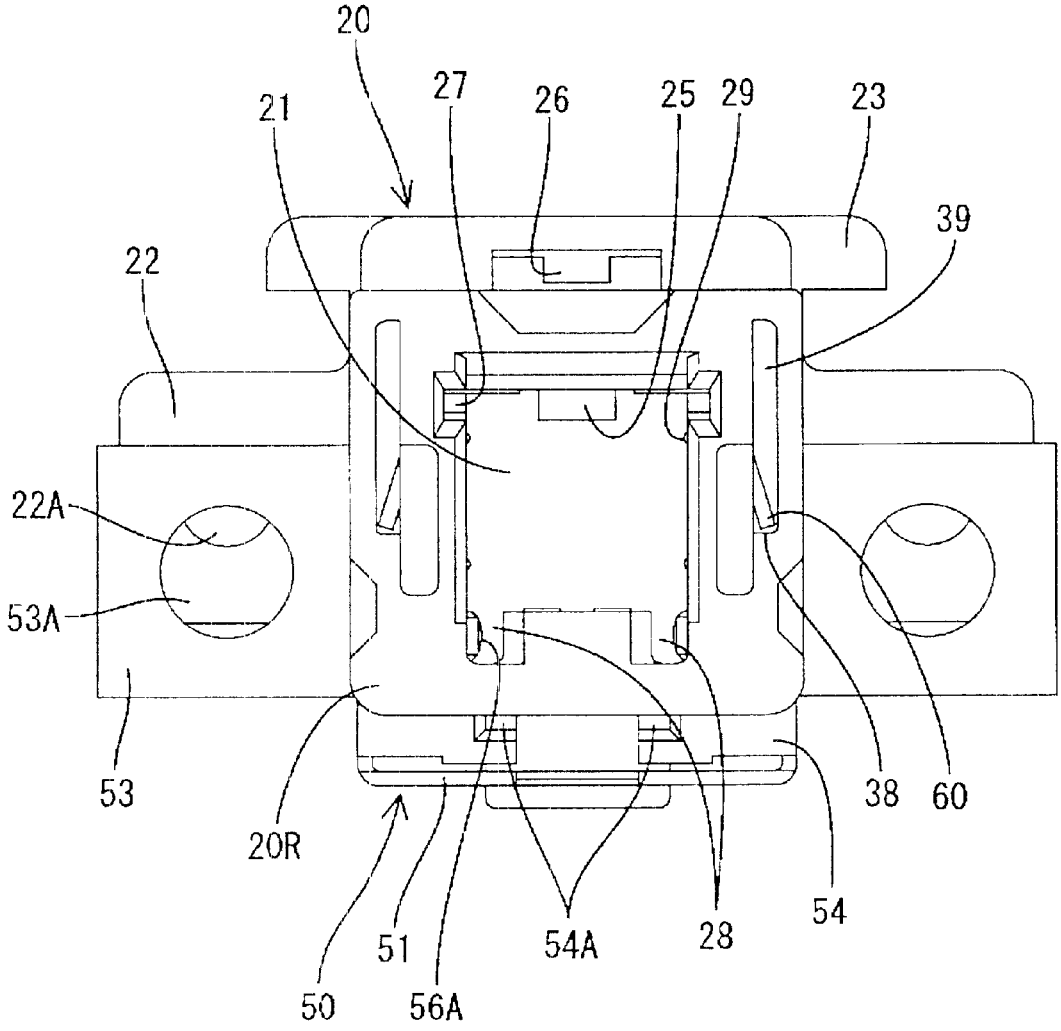
FIG. 13 is a rear view of the connector with the ground terminal mounted at the partial locking position.

Upper edges of the touching pieces 59 of the ground terminal 50 are below the guide grooves 27 in the housing 20 when the ground terminal 50 is in the partial locking position, and the contact pieces 56 of the ground terminal 50 are in the detection grooves 28. However, upper ends are lower than the bottom wall of the cavity 21 as shown in FIG. 13. Accordingly, the shielding terminal 15 can be inserted into the cavity 21 without interfering with the ground terminal 50 when the ground terminal 50 is at the partial locking position. When the shielding terminal 15 is inserted to specified depth in the cavity 21, the lock 25 engages the locking edge 16A of the shielding shell 16 to achieve partial locking. The elongated projections 29 are provided on the back sides of the left and right surfaces and the bottom surface of the cavity 21. Thus, the inserted shielding terminal 15 can be held so as not to shake.

The contact leading end portions 56A of the contact pieces 56 are located in the detection grooves 28 when the ground terminal 50 is at the partial locking position. Thus, the connector 10 can be placed on a photoelectric detector and light or laser beams can be projected in the longitudinal direction of the detection grooves 28. The laser beams can be detected at the light receiving sides if the ground terminal 50 is properly at the partial locking position. Therefore, a mounting error of the ground terminal 50 can be detected automatically based on such a detection result. The presence of the contact leading end portions 56A of the contact pieces 56 in the detection grooves 28 also can be detected visually.

The ground terminal 50 can be pushed further from the partial locking position. As a result, the full locking pieces 54 deform resiliently inward and enter into the mount holes 31. The full locking pieces 54 are restored resiliently when the full locking projections 54A align with the inner walls of the detection grooves 28. As a result, the full locking projections 54A engage the inner walls of the detection grooves 28 and the entire ground terminal 50 is located at the full locking position (see FIG. 16).

The touching pieces 59 enter the guide grooves 27 located behind the stabilizers 19 of the shielding terminal 15 when the ground terminal 50 is at the full locking position. Thus the shielding terminal 15 is prevented from coming out of the cavity 21. In this way, the lock 25 and the ground terminal 50 doubly lock the shielding terminal 15. When the ground terminal 50 reaches the full locking position, the contact leading end portions 56A of the contact pieces 56 resiliently contact the shielding shell 16 of the shielding terminal 15 from opposite sides. Further, the upper edges of the full locking pieces 54 contact the bottom surface of the shielding terminal 15. Thus, the shielding terminal 15 is pushed up and prevented from being shaken along the vertical direction.

The stabilizers 19 block the hooking portions 36 of the stepped grooves 34B if the shielding terminal 15 is inserted insufficiently. Thus, the touching pieces 59 cannot enter the guide grooves 27, and an operator can notice the insufficient insertion of the shielding terminal 15 by such an abnormality.

The through holes 53A of the surrounding pieces 53 and the fixing holes 22A of the fixing pieces 22 are aligned when the ground terminal 50 reaches the full locking position on the housing 20. Thus, the entire connector 10 can be mounted into the mount hole A formed in the wall surface of the shielded casing C by screws B if the ground terminal 50 is at the full locking position. However, the through holes 53A of the surrounding pieces 53 and the fixing holes 22A of the fixing pieces 22 are not aligned before the ground terminal 50 reaches the full locking position. Thus, the screws B cannot be inserted through the mount holes A, the through holes 53A and the fixing holes 22A unless the ground terminal 50 is at the full locking position. Accordingly, a mounting error of the ground terminal 50 can be detected when the connector 10 is mounted in the shielded casing C. Of course, the error can be detected also visually and/or automatically before mounting of the connector 10.

The shielding terminal 15 can be withdrawn from the housing 20 for maintenance by inserting a jig into a disengaging recess 21A formed at the bottom of the housing 20 to push the bottom wall 51 of the ground terminal 50 down or outward. Thus, the ground terminal 50 is pushed to the partial locking position to cancel locking by the ground terminal 50. Further, a jig may be inserted from the front side of the connector 10 to cancel locking by the lock 25.

As described above, the shielding terminal 15 can be locked partly by the lock 25 of the cavity 21 and can be locked fully by the touching pieces 59 of the ground terminal 50 to achieve double locking. Further, the ground terminal 50 is mounted in a direction D that intersects the insertion direction ID of the shielding terminal 50. Thus, the shielding terminal 15 can be locked securely so as not to come out.

The shielding terminal 15 can be mounted after the housing 20 and the ground terminal 50 are assembled into an integral unit by mounting the ground terminal 50 at the partial locking position with respect to the housing 20. Accordingly, it is not necessary to hold the housing 20 and the ground terminal 50 separately. Furthermore, the contact pieces 56 do not contact the shielding terminal 15 when the ground terminal 50 is at the partial locking position. Thus, insertion resistance of the shielding terminal 15 can be reduced.

The contact pieces 56 are between the bottom wall 51 and the engaging pieces 57 in the ground terminal 50. Therefore, the contact pieces 56 are protected from deformation by preventing the contact pieces 56 from being caught by another member or an operator during assembling.

The location of the contact leading end portions 56A of the contact pieces 56 of the ground terminal 50 at the partial locking position can be detected by causing the beams for photoelectric detection to pass along the detection grooves 28. Thus, defective products in which the contact pieces 56 are displaced from their proper positions can be left out before shipment.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The male shielding terminal 15 is used in the foregoing embodiment. However, a female shielding terminal may be used.

The contact pieces 56 enter the cavity 21 from their retracted positions as the ground terminal 50 is moved from the partial locking position to the full locking position and are brought into contact with the shielding terminal 15. However, the contact pieces 56 may be arranged in the cavity 21 beforehand.

The shielding terminal 15 is locked doubly, i.e. partially locked by the lock 25 and by moving the ground terminal 50 to the second or full locking position. However, the shielding terminal 15 may be locked by the grounding terminal 50 only without additional locking means in the housing or the like.

What is claimed is:

1. A connector (10) for mounting to an electrically conductive fixed article (C), the connector (10) comprising:

a housing (20) at least partly accommodating the shielding terminal (15);

a shielding terminal (15) inserted into the housing (20), the shielding terminal (15) comprising an inner terminal and a shielding shell (16) substantially surrounding the inner terminal; and a ground terminal (50) mounted on the housing (20) and electrically shorting the shielding shell (16) to the fixed article (C), the ground terminal (50) comprising full locking means for locking the shielding terminal (15) in the housing (20).

2. The connector of claim 1, wherein the ground terminal (50) is mounted on the housing (20) for movement between a partial locking position (FIG. 14) where insertion and withdrawal of the shielding terminal (15) into the housing is permitted and a full locking position (FIGS. 15; 16) where the full locking means of the ground terminal (50) fully locks the shielding terminal (15).

3. The connector of claim 2, wherein both the housing (20) and the ground terminal (50) are formed with mount holes (22A, 53A) through which a mounting member (B) is insertable to fix the shielding terminal (15) to the fixed article (C).

Figure 15:
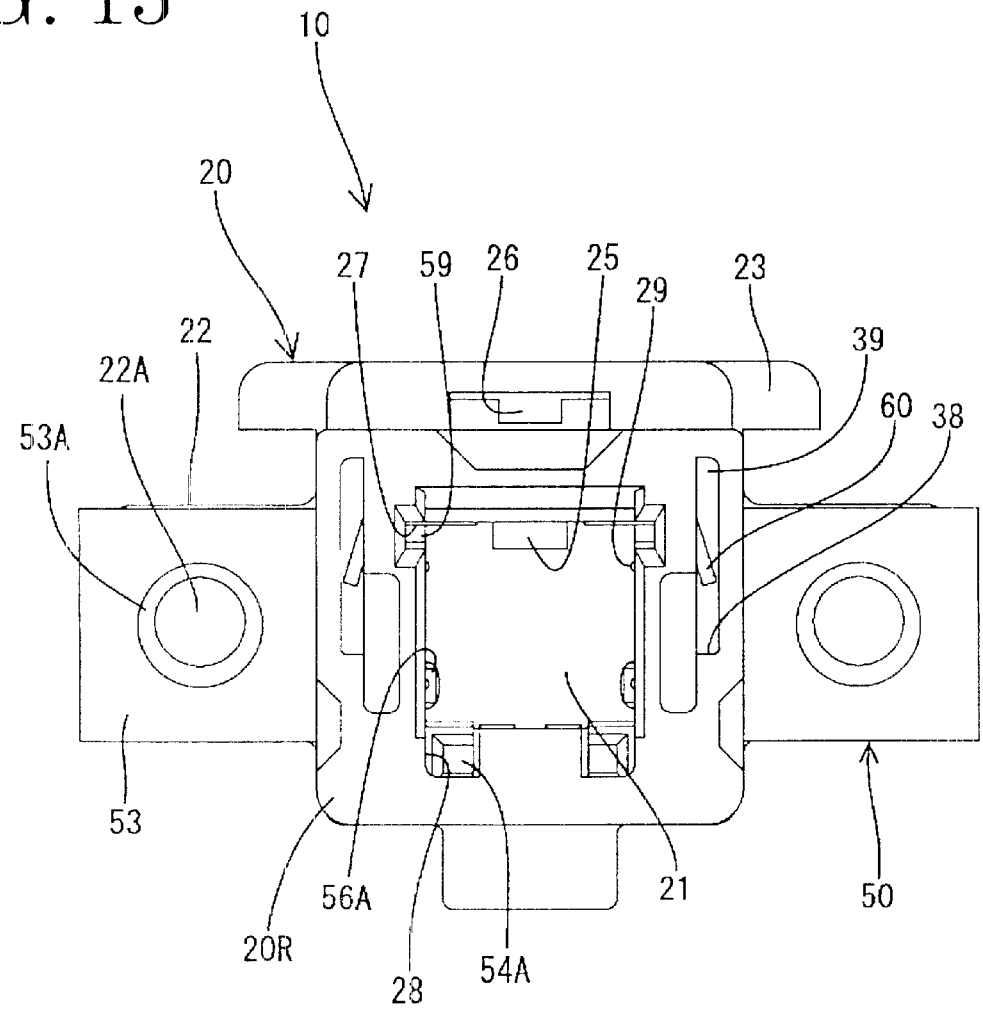
FIG. 15 is a rear view of the housing with the ground terminal mounted at the full locking position.
Figure 16:
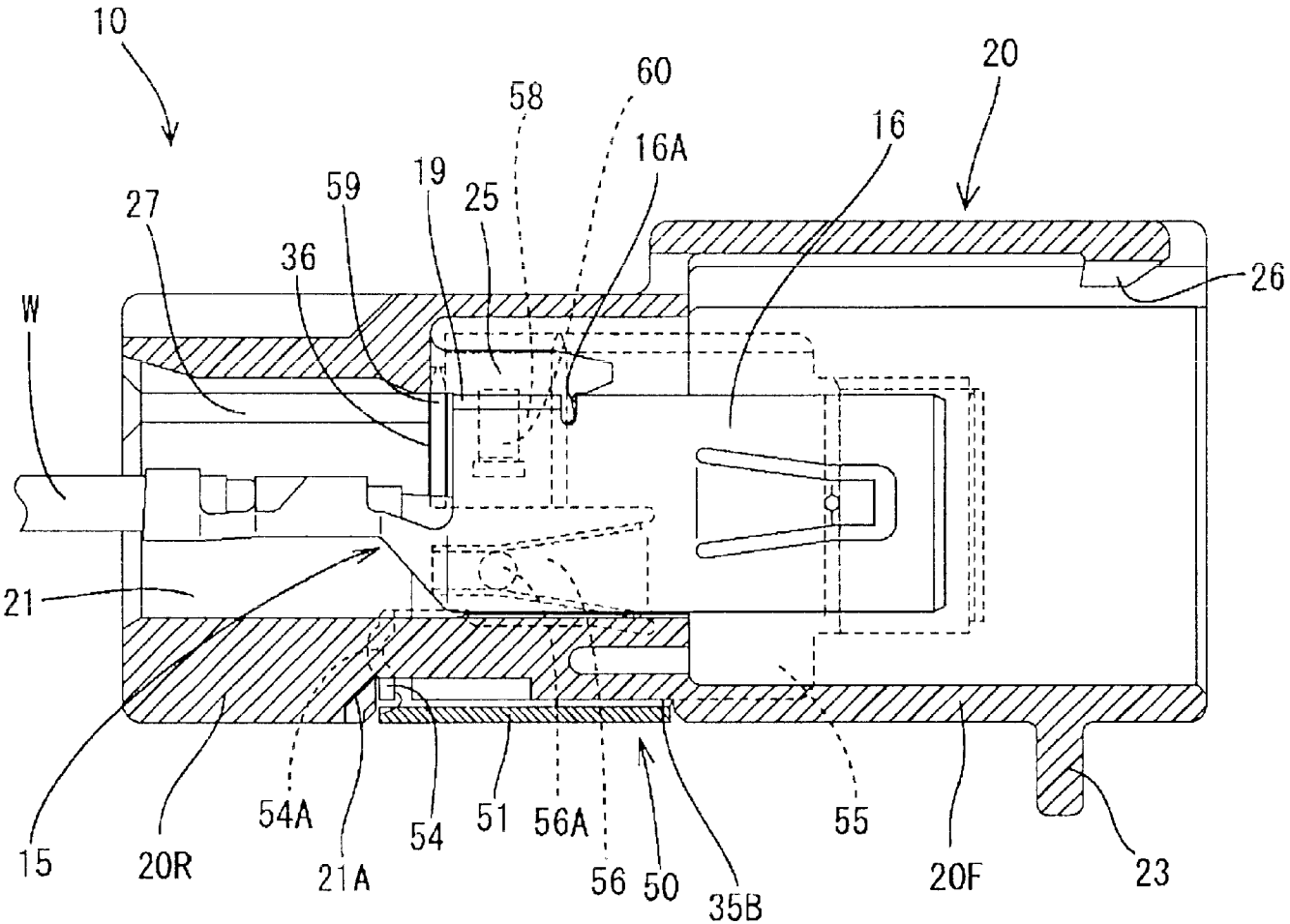
FIG. 16 is a side view in section of the connector in which a shielding terminal is doubly locked.

4. The connector of claim 3, wherein the mount holes (22A) of the housing (20) and the mount holes (53A) the ground terminal (50) are not aligned when the ground terminal (50) is at the partial locking position (FIG. 14) while being substantially aligned when the ground terminal (50) is at the full locking position (FIGS. 15; 16).

5. The connector of claim 4, wherein the full locking means of the ground terminal (50) comprises a contact piece (56) configured for contacting the shielding shell (16) when the ground terminal (50) is at the full locking position (FIGS. 15; 16) and being spaced from the shielding shell (16) when the ground terminal (50) is at the partial locking position (FIG. 14).

6. The connector of claim 2, wherein the ground terminal (50) has a leading end portion (56A) disposed in a detecting portion (28) of the housing (20) when the ground terminal (50) is in the partial locking position (FIG. 14).

7. The connector of claim 6, wherein the leading end portion (56A) of the ground terminal (50) is exposed at a position detectable from outside when the ground terminal (50) is at the partial locking position (FIG. 14).

8. A method for mounting a connector (10) used for fixing a shielding to an electrically conductive fixed article (C), comprising:

providing a housing (20);

providing a shielding terminal (15) having an inner terminal and a shielding shell (16) at least partly surrounding the inner terminal;

inserting the shielding terminal (15) into the housing (20); and mounting a ground terminal (50) on the housing (20) to electrically short the shielding shell (16) and the fixed article (C) and to lock the shielding terminal (15) in the housing (20).

9. The method of claim 8, wherein the ground terminal (50) is moved between a partial locking position (FIG. 14) where insertion and withdrawal of the shielding terminal (15) are permitted and a full locking position (FIGS. 15; 16) where the ground terminal (50) fully locks the shielding terminal (15).

10. The method of claim 9, further comprising a step of detecting whether the ground hole (50) is in the partial locking position (FIG. 14) by verifying whether a portion (56A) thereof is arranged in a detecting portion (28) of the housing (20).

* * * * *